US009327858B2

(12) United States Patent
Sato

(10) Patent No.: US 9,327,858 B2
(45) Date of Patent: May 3, 2016

(54) DISPLAY LABEL MANUFACTURING APPARATUS

(75) Inventor: Hiromi Sato, Tokyo (JP)

(73) Assignee: SATO HOLDINGS KABUSHIKI KAISHA (JP)

( * ) Notice: Subject to any disclaimer, the term of this patent is extended or adjusted under 35 U.S.C. 154(b) by 318 days.

(21) Appl. No.: 14/003,568

(22) PCT Filed: Mar. 27, 2012

(86) PCT No.: PCT/JP2012/002112

§ 371 (c)(1),
(2), (4) Date: Dec. 12, 2013

(87) PCT Pub. No.: WO2012/137441

PCT Pub. Date: Oct. 11, 2012

(65) Prior Publication Data

US 2014/0083618 A1 Mar. 27, 2014

(30) Foreign Application Priority Data

Apr. 5, 2011 (JP) ..... 2011-083509

(51) Int. Cl.
*B65C 9/46* (2006.01)
*B65C 11/02* (2006.01)
(Continued)

(52) U.S. Cl.
CPC ..... *B65C 9/0015* (2013.01); *B31D 1/021* (2013.01); *B31D 1/025* (2013.01); *Y10T 156/17* (2015.01)

(58) Field of Classification Search
USPC ..... 156/387, 537, 540, 541, 750, 764, 766, 156/767
See application file for complete search history.

(56) References Cited

U.S. PATENT DOCUMENTS 5,783,018 A * 7/1998 Gore ..... B08B 7/0028 156/238
2006/0060657 A1 3/2006 Choong et al.
2006/0070700 A1* 4/2006 Cone ..... B31D 1/021 156/249

FOREIGN PATENT DOCUMENTS

| | | |
|---|---|---|
| DE | 20 2010 004 060 U1 | 7/2010 |
| JP | 2005-91699 | 4/2005 |
| JP | 2007-178558 | 7/2007 |
| JP | 2008-183872 | 8/2008 |

OTHER PUBLICATIONS

International Search Report dated Jun. 5, 2012 issued in corresponding International patent application No. PCT/JP2012/002112.
(Continued)

*Primary Examiner* — Sing P Chan
(74) *Attorney, Agent, or Firm* — Ostrolenk Faber LLP

(57) ABSTRACT

A label manufacturing apparatus manufactures a label L having a sub-label Lb bonded to a predetermined position on a main label La. A main label conveyance mechanism 10 conveys a main continuous label strip Ta in a first direction Da. A sub-label conveyance mechanism 20 conveys a sub-continuous label strip Tb in a second direction which crosses the first direction. The sub-labels Lb arranged in series on a backing strip Db, are separated from their backing strip and are each bonded to the surface of a respective main label La by a bonding mechanism. The completed display label L is separated from its backing strip Db of the main continuous label strip Ta. The label manufacturing apparatus can adjust the relative bonding position between the sub-label and the main label La so as to allow the sub-label bonding mechanism 20 to bond the sub-label Lb to the main label La at a predetermined position.

7 Claims, 8 Drawing Sheets

(51) Int. Cl.

| | |
|---|---|
| ***B29C 65/48*** | (2006.01) |
| ***B32B 37/26*** | (2006.01) |
| ***B32B 38/10*** | (2006.01) |
| ***B32B 38/14*** | (2006.01) |
| ***B65C 9/00*** | (2006.01) |
| ***B31D 1/02*** | (2006.01) |

(56) References Cited

OTHER PUBLICATIONS

Extended European Search Report and Search Opinion dated Sep. 26, 2014 in corresponding European Patent Application No. EP 12 76 7576 (7 pages).

* cited by examiner (a)

(b)

DISPLAY LABEL MANUFACTURING APPARATUS

CROSS-REFERENCE TO RELATED APPLICATIONS

The present application is a 35 U.S.C. §§371 national phase conversion of PCT/JP2012/002112 filed Mar. 27, 2012, which claims priority of Japanese Patent Application No. 2011-083509, filed Apr. 5, 2011, the contents of which are incorporated by reference herein. The PCT International Application was published in the Japanese language.

TECHNICAL FIELD

The present invention relates to a display label manufacturing apparatus configured to manufacture a display label having a structure in which a sub-label such as an anti-counterfeit hologram sheet or the like is bonded to a predetermined position on a main label having a surface on which information is displayed, for example.

BACKGROUND ART

In recent years, as a countermeasure to deal with illegal copies, for example, of luxury brand goods, machining tools, electronic components, and so forth, a method is employed in which a hologram sheet is employed as a display label, so as to allow customers to clearly distinguish commercial products from copy products. With regard to such hologram sheets, there are, for example, two types: one is a transparent type, and the other is a type having a reflecting layer to make the hologram easy to see. Such a display label is formed as follows. That is to say, as shown in FIG. 7, a sub-label Lb configured as a hologram sheet having a size that is smaller than that of a main label La and having an adhesive layer on its back face is bonded to a predetermined position on the main label La having a surface on which information is displayed, e.g., a position at which a printed barcode or the like is displayed. As a conventional method for manufacturing such a display label L, a method is known employing a main continuous label strip Ta having a structure in which multiple main labels La are arranged in series at predetermined intervals on a backing strip Da such that they are temporarily bonded to the backing strip Da, and a sub-continuous label strip Tb having a structure in which multiple sub-labels Lb are arranged in series at predetermined intervals on a backing strip Db such that they are temporarily bonded to the backing strip Db. By means of a known conventional label printer, required information is printed on the main labels La of the main continuous label strip Ta, thereby providing the main labels La. Furthermore, by means of a known conventional label supply apparatus, the sub-labels Lb are provided from the sub-continuous label strip Tb. Subsequently, for example, the sub-labels Lb thus provided are manually taken off, and each sub-label Lb thus taken off is manually bonded to a main label La provided from the label printer.

However, such a manufacturing process in which each sub-label Lb is manually bonded to the main label La is troublesome, and thus automation of this process has been investigated. For example, a method is conceivable in which a manufacturing apparatus having the same configuration as that of a laminate label manufacturing apparatus (see Japanese Patent Application Laid Open No. 2008-183872) proposed by the present inventor is employed. As shown in FIG. 8, a laminate label M has a structure in which a label piece Ma having a front face on which information is printed and having an adhesive layer on its back face is coated with a film piece Mb configured as a transparent film or otherwise a translucent film having approximately the same size as that of the label piece Ma. Such a laminate label M manufacturing apparatus employs a label piece continuous strip Qa having a structure in which the label pieces Ma are arranged in series at predetermined intervals on a backing strip Na such that they are temporarily bonded to the backing strip Na, and a film piece continuous strip Qb having a structure in which the film pieces Mb are arranged in series at predetermined intervals on a backing strip Nb such that they are temporarily bonded to the backing strip Nb. With such a method, by means of a label printer mechanism 100, the label piece continuous strip Qa is conveyed along its longitudinal direction. In the conveying operation, the required information is printed on each label piece Ma by means of a printing unit 101 while the label piece continuous strip Qa is conveyed. On the other hand, by means of a label bonding mechanism 102, the film piece continuous strip Qb is conveyed along its longitudinal direction. In the conveying operation, the backing strip Nb is folded back so as to separate each film piece Mb from the backing strip Nb. Each film piece Mb thus separated is held by attracting and holding by a attracting and holding plate 103 included in the label bonding mechanism 102, and is advanced toward and bonded to the corresponding label piece Ma of the label piece continuous strip Qa conveyed from the label printer mechanism 100.

Patent document: Patent Application Laid Open No. 2008-183872.

SUMMARY OF INVENTION

Technical Problem

A method in which such a conventional laminate label manufacturing apparatus is applied to a manufacturing method for a display label L having a structure in which the aforementioned sub-label Lb is bonded to the aforementioned main label La, i.e., a method in which the label piece Ma is replaced with the main label La, and the film piece Mb is replaced with the sub-label Lb, has a problem as follows. That is to say, with such a conventional label manufacturing method, the label piece Ma has approximately the same size as that of the film piece Mb. Accordingly, there is an unambiguous bonding position relation between the label piece Ma and the film piece Mb. In contrast, in a case in which the sub-label Lb having a smaller size than that of the main label La is bonded to the main label La, the bonding position at which the sub-label Lb is to be bonded to the main label La varies according to the kind of display label L. Thus, in order to configure such a conventional laminate label manufacturing apparatus to support the aforementioned display label manufacturing, there is a need to change the operation settings of the label printer mechanism 100 and the label bonding mechanism 102 for each display label L. That is to say, such a conventional laminate label manufacturing apparatus cannot be applied as-is to the aforementioned display label manufacturing, which is a problem.

The present invention has been made in order to solve the aforementioned problem. Accordingly, it is a purpose of the present invention to provide an automated display label manufacturing apparatus configured to manufacture a display label, and to be capable of supporting such automated display label manufacturing in a simple manner even if the bonding position at which a sub-label is to be bonded to a main label is changed according to the kind of display label.

Solution to Problem

In order to solve the aforementioned problem, a display label manufacturing apparatus according to the present invention is configured to manufacture a display label having a structure in which a sub-label having a smaller size than that of a main label and having an adhesive layer on its back face is bonded, at a predetermined position specified beforehand, to the main label having information displayed on its surface. The display label manufacturing apparatus employs a main continuous label strip having a structure in which the aforementioned main labels are arranged in series at predetermined intervals on a backing strip such that they are temporarily bonded to the backing strip, and a sub-continuous label strip having a structure in which the aforementioned sub-labels are arranged in series at predetermined intervals on a backing strip and are temporarily bonded to the backing strip. The display label manufacturing apparatus comprises: a main label conveyance mechanism configured to convey the main continuous label strip along its longitudinal direction; and a sub-label bonding mechanism configured to convey the sub-continuous label strip along its longitudinal direction, to separate the sub-label of the sub-continuous label strip thus conveyed from the backing strip, and to bond the sub-label thus separated to a surface of the main label of the main continuous label strip in a conveyance step for conveying the main continuous label strip, thereby manufacturing the display label on the backing strip of the main continuous label strip. The display label manufacturing apparatus is configured to allow a relative bonding position of the sub-label bonding mechanism to the main label to be adjusted so as to allow the sub-label bonding mechanism to bond the sub-label to the main label at a predetermined position.

With such an arrangement, in the conveyance step for conveying the main continuous label strip, the sub-label bonding mechanism is configured to separate the sub-label of the sub-continuous label strip thus conveyed from the backing strip, and to bond the sub-label thus separated to the surface of the main label. Thus, such an arrangement is capable of forming by automation the display label on the backing strip of the main continuous label strip. For example, in a case of manufacturing a display label having a structure in which the sub-label configured as a hologram sheet having a smaller size than that of the main label and having an adhesive layer on its back face is bonded to the main label, such an arrangement allows the sub-label to be bonded at a predetermined position specified beforehand, e.g., at a position where a barcode has been printed, to the main label on the surface of which information is displayed. In a case of changing the content displayed on the main label, the size of the main label, or the like, there is a need to change the bonding position at which the sub-label is to be bonded. The apparatus according to the present embodiment is configured to allow the user to adjust the relative bonding position of the sub-label bonding mechanism to the main label. Thus, by adjusting the bonding position beforehand, such an arrangement allows the sub-label bonding mechanism to bond the sub-label to the main label at a predetermined position. Thus, such an arrangement supports the manufacture of various types of display labels.

Also, as necessary, the display label manufacturing apparatus may further comprise a bonding table configured to receive the main continuous label strip conveyed by the main label conveyance mechanism in a conveyance step for conveying the main continuous label strip, so as to allow bonding of the sub-label to be performed. Also, the sub-label bonding mechanism may be configured including: a separating unit configured to convey the sub-continuous label strip along its longitudinal direction, and to fold back the backing strip of the sub-continuous label strip in the conveyance step for conveying the sub-continuous label strip, so as to separate the sub-label temporarily bonded to the backing strip; and a bonding unit comprising a attracting and holding plate configured to move between a attracting and holding position at which the sub-label separated by the separating unit is held by attracting and holding such that its attracting and holding face is in contact with the surface of the sub-label and a bonding position at which the sub-label thus held by attracting and holding is bonded to the main label temporarily bonded to the backing strip mounted on the bonding table. The bonding unit is configured employing such a attracting and holding plate. Thus, such an arrangement is capable of holding the sub-label by attracting and holding, and of bonding the sub-label thus held to the main label. This allows the sub-label to be bonded to the main label in a sure manner.

Also, as necessary, the display label manufacturing apparatus may further comprise a printing unit arranged on an upstream side of the bonding table, and configured to print and display required information on the main label of the main continuous label strip. The main label conveyance mechanism may be configured to convey the main continuous label strip by a predetermined length from the printing unit, and to hold the main label, to which the sub-label is to be bonded, on the bonding table during a bonding period in which the sub-label bonding mechanism performs bonding of the sub-label. Also, the printing unit may be configured such that it can be moved with respect to the bonding table, thereby allowing the stop position set for the main label to be changed with respect to the bonding table. Also, the sub-label bonding mechanism may be configured to allow the attracting and holding position of the attracting and holding plate thereof to be changed along a direction that crosses the conveyance direction in which the main label is conveyed on the bonding table.

With such an arrangement, the conveyance length of the main continuous label strip conveyed from the printing unit by means of the main label conveyance mechanism is maintained at a predetermined length. Thus, by moving the position of the printing unit such that it is positioned at a required position, such an arrangement is capable of changing the stop position of the main label with respect to the bonding table. Thus, such an arrangement is capable of adjusting the relative position relation between the main label and the attracting and holding plate on the bonding table along the main label conveyance direction. Furthermore, such an arrangement allows the sub-label bonding mechanism to change the attracting and holding position set for the attracting and holding plate. Thus, such an arrangement is capable of adjusting the relative position relation between the main label and the attracting and holding plate on the bonding table along a direction that crosses the main label conveyance direction. Such an arrangement allows the user to adjust the position of the printing unit along a single direction, and to adjust the position of the attracting and holding plate along another single direction that crosses the direction set for the printing unit. Thus, such an arrangement provides a simple configuration. Such an arrangement allows the user to adjust the bonding position in a simple manner in a case in which the sub-label bonding position is to be changed according to a change in the display content to be printed on the main label, a change in the size of the main label La, or the like.

Also, as necessary, the display label manufacturing apparatus may further comprise: an apparatus base comprising the bonding table; a main label mounting unit comprising the printing unit; and a sub-label mounting unit comprising the sub-label bonding mechanism. Also, the main label mounting unit may be supported on the apparatus base so as to allow it to be moved along a conveyance direction in which the main label is conveyed on the bonding table, and to be positioned at a desired position. Also, the sub-label mounting unit may be supported on the apparatus base so as to allow it to be moved in a direction that is orthogonal to the conveyance direction in which the main label is conveyed, and to be positioned at a desired position.

Such an arrangement allows the main label mounting unit to be moved and positioned with respect to the apparatus base, so as to set the position of the printing unit to a required position. Thus, such an arrangement is capable of adjusting the relative position relation between the main label and the attracting and holding plate on the bonding table along the main label conveyance direction. Furthermore, such an arrangement allows the sub-label mounting unit to be moved and positioned with respect to the apparatus base, so as to set the attracting and holding position of the attracting and holding plate to be at a required position. Thus, such an arrangement is capable of adjusting the relative position relation between the main label and the attracting and holding plate on the bonding table along the direction that is orthogonal to the main label conveyance direction. That is to say, such an arrangement allows the positions of the main label mounting unit and the sub-label mounting unit to be adjusted. Furthermore, such an arrangement only requires the user to move and position the positions of the main label mounting unit and the sub-label mounting unit in single directions that are respectively mutually orthogonal. Thus, such an arrangement provides a simple configuration. At the same time, such an arrangement provides highly improved operability.

Advantageous Effects of Invention

With the present invention, in the main continuous label strip conveyance step, the sub-label bonding mechanism is configured to separate, from the backing strip, the sub-label of the sub-continuous label strip thus conveyed, and to bond the sub-label thus separated to the surface of the main label of the main continuous label strip. Thus, such an arrangement is capable of forming by automation the display label on the backing strip of the main continuous label strip. That is to say, such an arrangement provides automated manufacturing of the display label. In a case in which the content to be displayed on the main label is changed, the size of the main label La is changed, or the like, there is a need to change the bonding position at which the sub-label is to be bonded. The apparatus according to the present invention is configured to allow the user to adjust the relative bonding position relation between the sub-label bonding mechanism and the main label. Thus, by adjusting the bonding position beforehand, such an arrangement allows the sub-label conveyance mechanism to bond the sub-label to the main label at a predetermined position. Thus, such an arrangement is capable of supporting the manufacture of various kinds of display labels L.

BRIEF DESCRIPTION OF DRAWINGS

FIGS. 2A and 2B each show the display label manufacturing apparatus according to the embodiment of the present invention, wherein FIG. 2A is a front view of the display label manufacturing apparatus after the main label mounting unit is moved toward its front side, and FIG. B is a front view of the display label manufacturing apparatus after the main label mounting unit is moved toward its rear side.

FIGS. 3A and 3B each show the display label manufacturing apparatus according to the embodiment of the present invention, wherein FIG. 3A is a side view of the display label manufacturing apparatus after the sub-label mounting unit is moved toward its front side, and FIG. 3B is a side view of the display label manufacturing apparatus after the sub-label mounting unit is moved toward its rear side.

FIGS. 4A and 4B each show principal components of a separating unit of a sub-label bonding mechanism included in the display label manufacturing apparatus according to the embodiment of the present invention, wherein FIG. 4A is a diagram showing a state in which a sub-continuous label strip is conveyed by means of the separating unit, and FIG. 4B is a diagram showing a state in which the conveyance of the sub-continuous label strip by the separating unit is suspended.

FIGS. 5A and 5B are diagrams each showing an operation of the display label manufacturing apparatus according to the embodiment of the present invention for adjusting the position relation between the main label and the attracting and holding plate of the sub-label bonding mechanism, wherein FIG. 5A is a perspective view of principal components showing the state after the main label is moved toward the rear side with respect to the bonding table, and FIG. 5B is a perspective view of principal components showing the state after the main label is moved toward the front side with respect to the bonding table.

DESCRIPTION OF EMBODIMENTS

Figure 7:
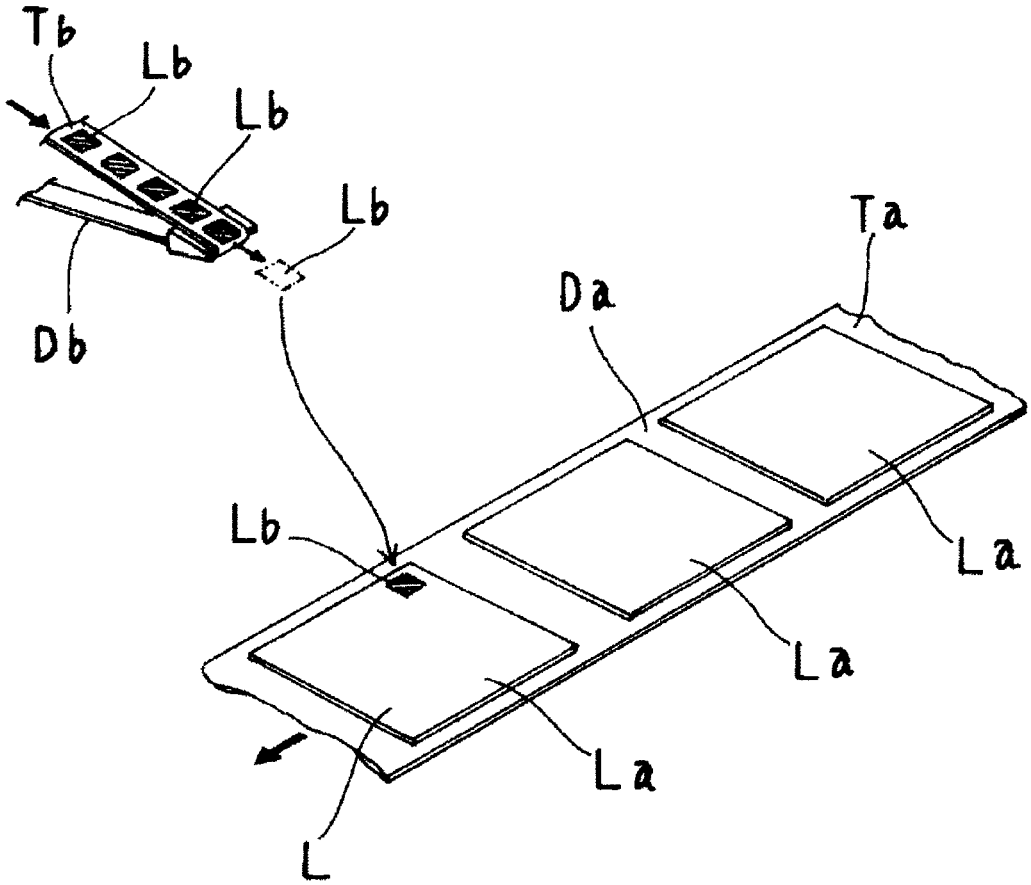
FIG. 7 is a perspective view showing the main continuous label strip and the sub-continuous label strip applied in the display label manufacturing apparatus according to the embodiment of the present invention.
Figure 8:
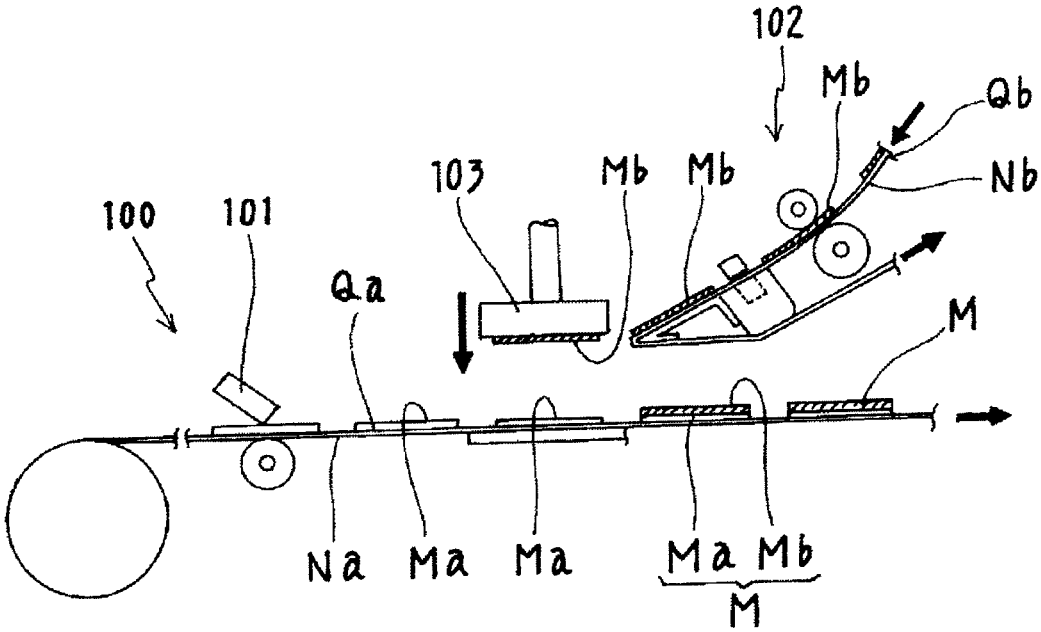
FIG. 8 is a diagram showing a conventional laminate label manufacturing apparatus.

Detailed description will be made below with reference to the appended drawings regarding a display label manufacturing apparatus according to an embodiment of the present invention. FIGS. 1 through 4 each show a display label manufacturing apparatus S according to an embodiment of the present invention. As also shown in FIG. 7, the display label manufacturing apparatus S according to the embodiment is configured to manufacture a display label L having a structure in which a sub-label Lb configured as a hologram sheet having a smaller size than that of a main label La and having an adhesive layer on its back face is bonded at a predetermined position, e.g., at a position where a barcode is printed, to the main label La having printed information on its front face and having an adhesive layer on its back face. With regard to hologram sheets, there are, for example, two types: one is a transparent type; and the other is a type having a reflecting layer to make the hologram easy to see. Examples employed as such a main label La include a white PET label, and a coated PET label having a structure in which the surface of the white PET label is coated with a resin composition, each of which is configured to allow information to be printed on the surface configured as a printing face, using a printer unit described later.

With the embodiment, a main continuous label strip Ta is employed, having a structure in which the main labels La are arranged in series at predetermined intervals on a backing strip Da such that they are temporarily bonded to the backing strip Da. Furthermore, a sub-continuous label strip Tb is employed, having a structure in which the sub-labels Lb are arranged in series at predetermined intervals on a backing strip Db such that they are temporarily bonded to the backing strip Db. The backing strip Db for the sub-labels Lb is configured as a translucent resin film. In the present embodiment, the backing strip Db is configured as a transparent resin film. The main continuous label strip Ta and the sub-continuous label strip Tb are each wound in the form of a roll.

The display label manufacturing apparatus S according to the embodiment has a basic configuration including an apparatus base 1, a main label conveyance mechanism 10 configured to convey the main continuous label strip Ta along its longitudinal direction, and a sub-label bonding mechanism 20 configured to convey the sub-continuous label strip Tb, and to separate each sub-label Lb of the sub-continuous label strip Tb thus conveyed from the backing strip Db, and to bond the sub-label Lb thus separated to the surface of the corresponding main label La on the main continuous label strip Ta.

The apparatus base 1 includes: a base 2 which is grounded; a first standing plate 3 erected on the central portion of the base 2; and a second standing plate 4 erected on the base 2 such that it is connected to the front end of the first standing plate 3 and such that it has a face that is orthogonal to the first erected plate 3. Furthermore, a bonding table 5 is provided to the apparatus base 1, configured to receive the main continuous label strip Ta conveyed by the main label conveyance mechanism 10 in the conveying step for conveying the main continuous label strip Ta, and to allow each sub-label Lb to be bonded to the main continuous label strip Ta. A passage opening 6 is formed in the aforementioned second standing plate 4 so as to allow the main continuous label strip Ta conveyed by the main label conveyance mechanism 10 to pass through the second standing plate 4. The bonding table 5 is arranged in front of the first standing plate 3, and is supported so as to provide a continuous path together with the passage opening 6. Furthermore, an unshown control unit configured to perform various kinds of control operations is mounted on the apparatus base 1. Moreover, an unshown cover is provided so as to cover the apparatus.

Figure 1:
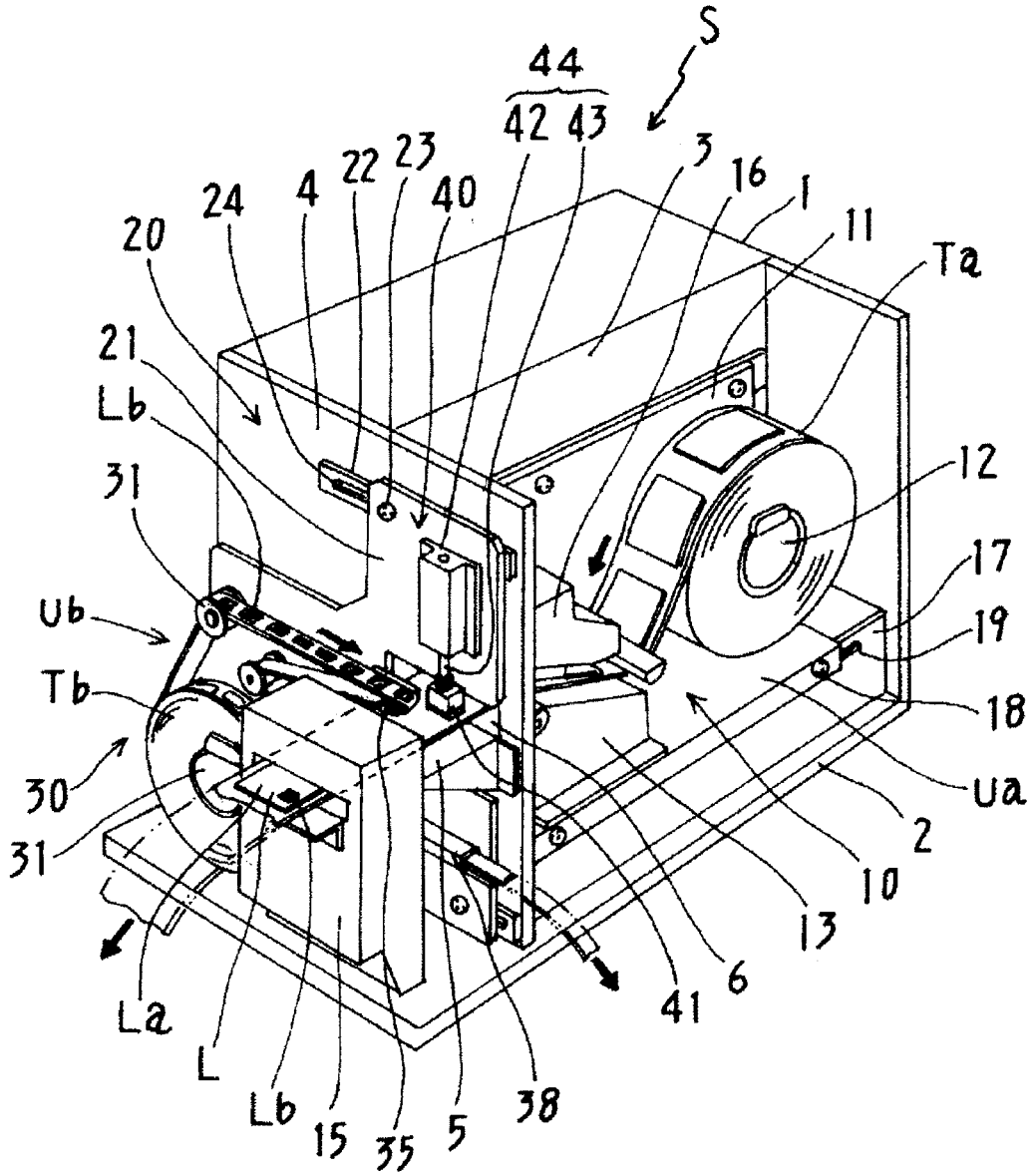
FIG. 1 is a perspective view showing a display label manufacturing apparatus according to an embodiment of the present invention.
Figure 2:
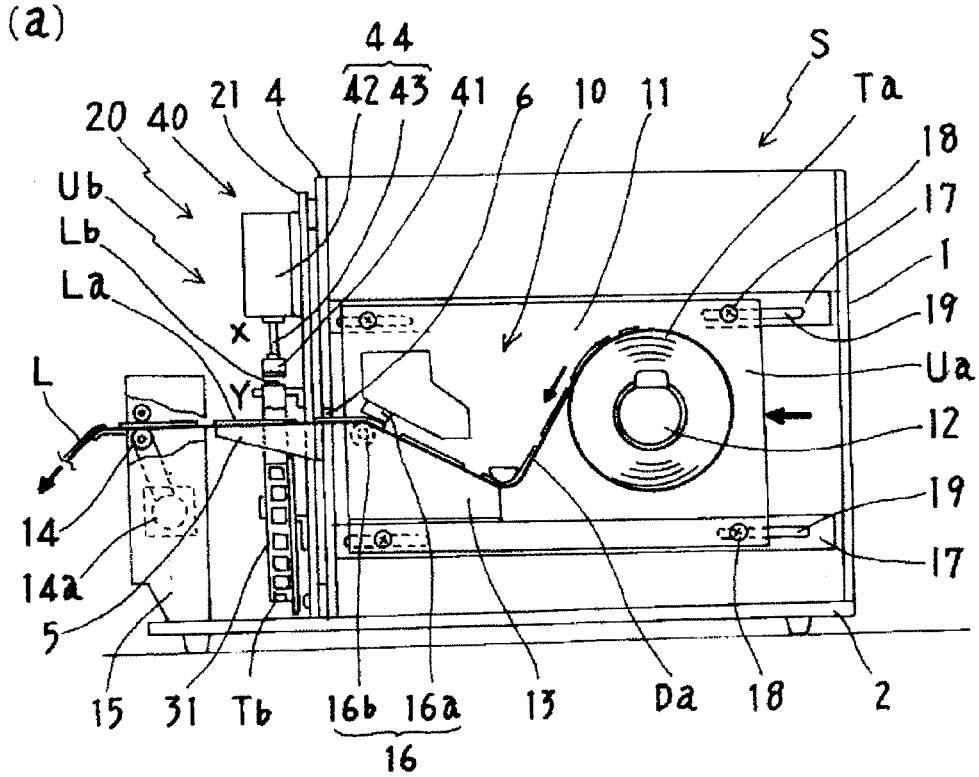
Figure 2:
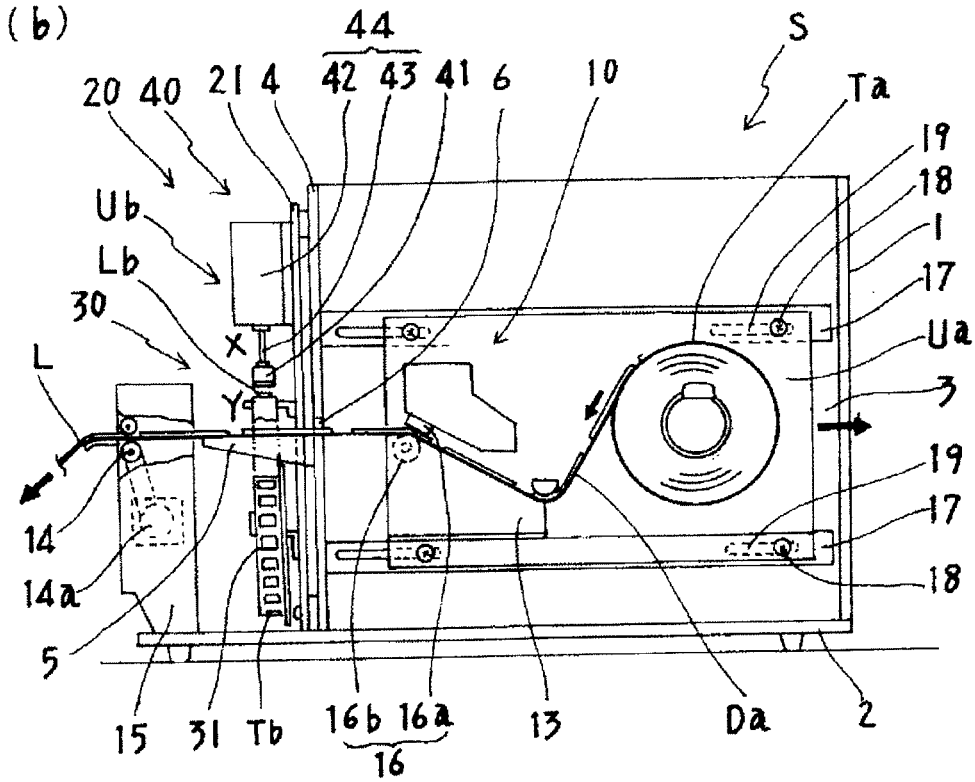

As shown in FIGS. 1 and 2, the main label conveyance mechanism 10 includes: a first base 11 supported by the first standing plate 3 of the apparatus base 1; a supply reel 12 arranged on the first base 11, and configured to wind back the backing strip Da configured as the main continuous label strip Ta wound in the form of a roll, so as to supply the main continuous label strip Ta; a guide unit 13 arranged on the first base 11, and configured to allow the main continuous label strip Ta received from the supply reel 12 to pass through the passage opening 6 formed in the second standing plate 4, and to discharge the main continuous label strip Ta so as to allow the bonding table 5 to receive the main continuous label strip Ta; and a pair of conveyance rollers 14 arranged on the front side of the first standing plate 3 erected on the base 2 of the apparatus base 1, and configured to draw and convey the main continuous label strip Ta from the bonding table 5. The conveyance rollers 14 are supported by a support member 15 mounted on the base 2, and are configured to be driven by means of an electric motor 14*a*.

A printing unit 16 is provided to the aforementioned first base 11 on the upstream side of the bonding table 5. The printing unit 16 is configured to print required information such that it is displayed on each main label La of the main continuous label strip Ta. The printing unit 16 comprises: a thermal-type printing head 16*a* configured to perform printing on each main label La temporarily bonded to the backing strip Da; and a platen 16*b*. Furthermore, the control unit (not shown) is provided. The control unit instructs the printing unit 16 to perform printing while it instructs the electric motor 14*a* to drive the aforementioned conveyance rollers 14 so as to convey the main continuous label strip Ta. After the printing, the control unit instructs the electric motor 14*a* to suspend the driving operation for the conveyance rollers 14 during a bonding period in which the sub-label Lb is bonded to the main label La. That is to say, the main label conveyance mechanism 10 is configured to control the electric motor 14*a* so as to drive the conveyance rollers 14 such that the main continuous label strip Ta is conveyed a predetermined length from the printing unit 16, and such that the conveyance of the main label La to be bonded to the sub-label Lb is stopped and is held on the bonding table 5 during a bonding period in which the sub-label Lb is bonded to the main label La by means of the sub-label bonding mechanism 20. It should be noted that the platen 16*b* is driven by an unshown electric motor. However, the unshown electric motor configured to drive the platen 16*b* is driven synchronously with the driving of the electric motor 14*a*, thereby conveying the main continuous label strip Ta.

Figure 5:
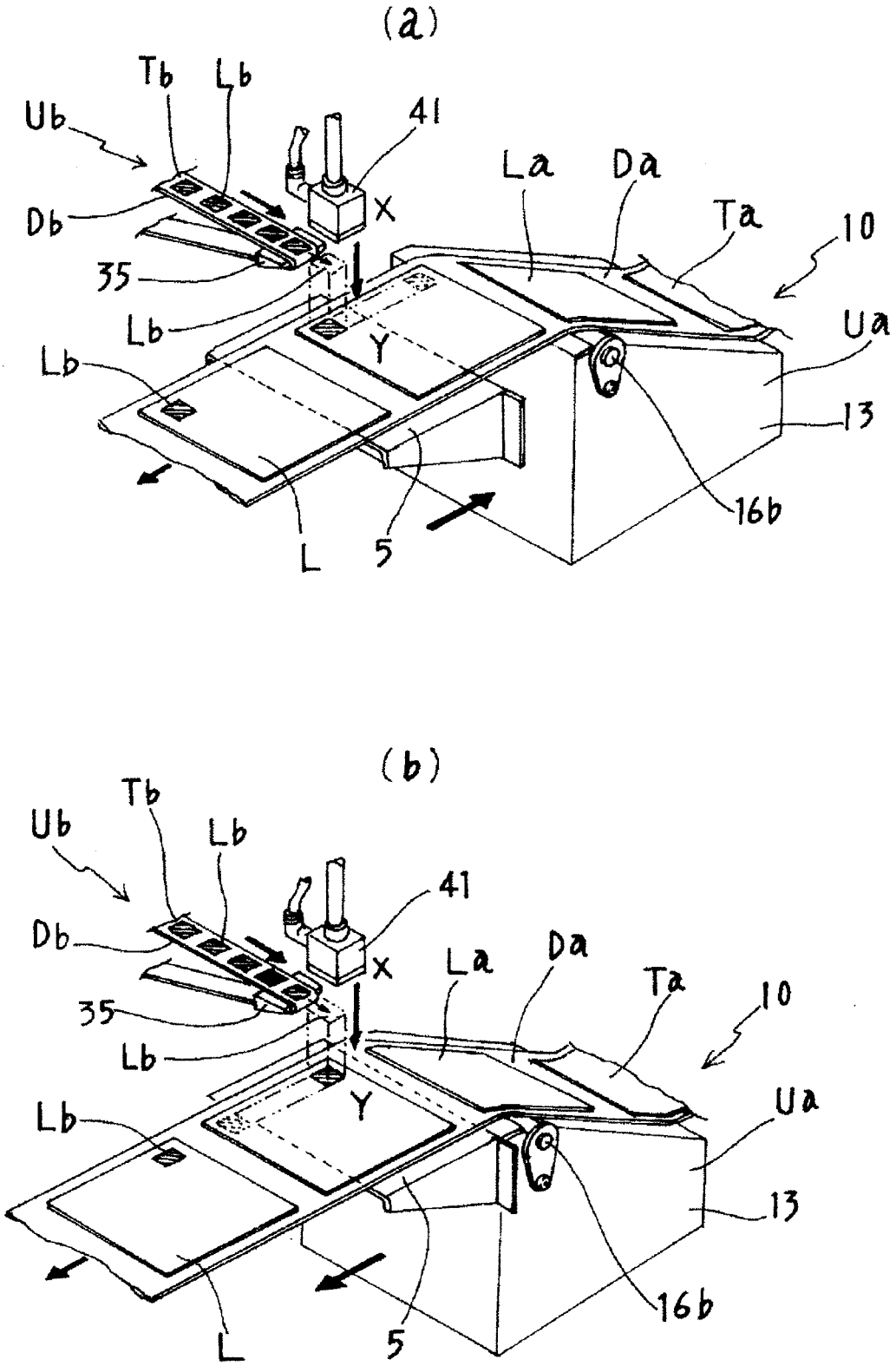

Furthermore, as shown in FIGS. 2 and 5, the main label conveyance mechanism 10 is configured to be capable of moving the printing unit 16 with respect to the bonding table 5, thereby allowing the stop position of the main label La to be changed with respect to the bonding table 5. Specifically, as shown in FIG. 2, in the main label conveyance mechanism 10, a main mounting unit Ua is configured including the printing unit 16, the supply reel 12, and the guide unit 13 mounted on the first base 11. The main label mounting unit Ua thus configured is supported by the apparatus base 1 such that it can be shifted along the conveyance direction in which the main labels La are conveyed on the bonding table 5, and such that it can be positioned at a desired position. Specifically, a pair of rails 17 are arranged on the first standing plate 3 such that they extend along the conveyance direction of the main label La. Furthermore, a slider (not shown) is movably supported by the rails 17. Moreover, the first base 11 is supported by the slider via screws 18. By tightening the screws 18, such an arrangement allows the user to fix the slider to the rails 17, and to perform positioning of the printing unit 16 mounted on the first base 11. Furthermore, by loosening the screws 18, such an arrangement allows the user to slide the slider, thereby allowing the printing unit 16 mounted on the first base 11 to be moved. Slots 19 are formed in each rail 17, which determine the range of movement of the screws 18, i.e., the range of movement of the first base 11 (the range of movement of the printing unit 16). Thus, such an arrangement allows the first base 11 to be moved in this range.

As shown in FIGS. 1 through 6, the sub-label bonding mechanism 20 is configured to convey the sub-continuous label strip Tb along its longitudinal direction, to separate each sub-label Lb of the sub-continuous label strip Tb thus conveyed from the backing strip Db, and to bond the sub-label Lb thus separated to the surface of the main label La of the main continuous label strip Ta mounted on the bonding table 5 in the conveyance step for conveying the main continuous label strip Ta, thereby forming each display label L on the backing strip Da of the main continuous label strip Ta. Specifically, the sub-label bonding mechanism 20 has a configuration including: a second base 21 supported on the second standing plate 4 mounted on the apparatus base 1; a separating unit 30 arranged on the second base 21, and configured to convey the sub-continuous label strip Tb along its longitudinal direction and to fold back the backing strip Db of the sub-continuous label strip Tb in the conveyance step for conveying the sub-continuous label strip Tb, so as to separate each sub-label Lb from the backing strip Db on which the sub-label Lb has been temporarily bonded; and a bonding unit 40 arranged on the second base 21, and including a attracting and holding plate 41 configured to hold by attracting and holding each sub-label Lb separated by the separating unit 30 at the attracting and holding position X such that its attracting and holding face is in contact with the surface of the sub-label Lb, and to shift the sub-label Lb thus held by attracting and holding to the bonding position Y where the sub-label Lb is to be bonded to the main label La temporarily bonded to the backing strip Da mounted on the bonding table 5.

Figure 3:
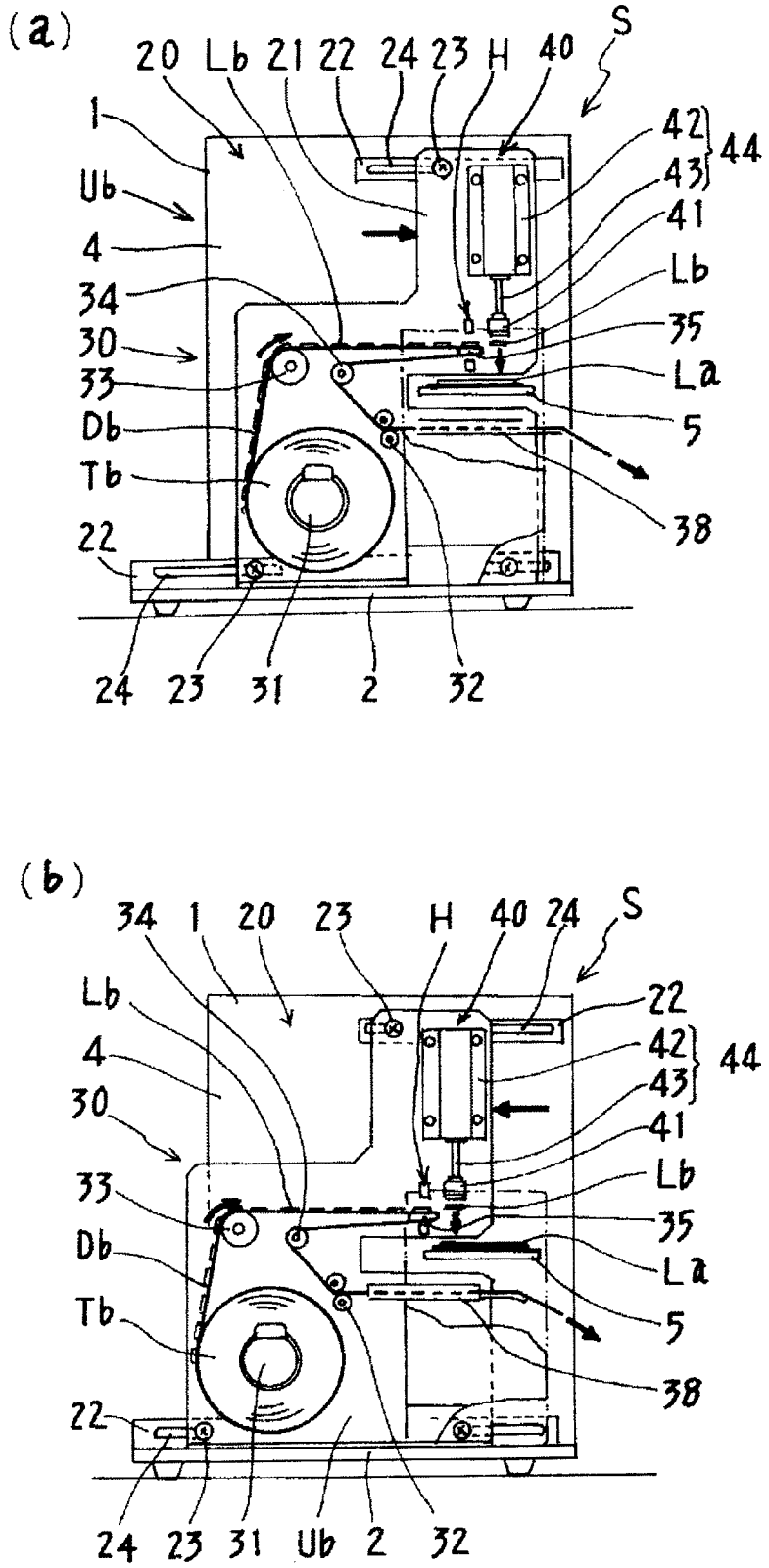

As shown in FIGS. 1 through 3, the separating unit 30 includes: a supply reel 31 configured to wind back the backing strip Da of the sub-continuous label strip Tb so as to supply the sub-continuous label strip Tb; a pair of conveyance rollers 32 (FIG. 3) arranged on the downstream side of the separating unit 30, and configured to draw and convey the sub-continuous label strip Tb; and guide rollers 33 and 34 configured to guide the sub-continuous label strip Tb. The conveyance rollers 32 are driven by an unshown electric motor. The reference numeral 38 denotes a guide member configured to guide the backing strip Db so as to discharge the backing strip Db toward the side of the apparatus after the sub-labels are separated.

Figure 4:
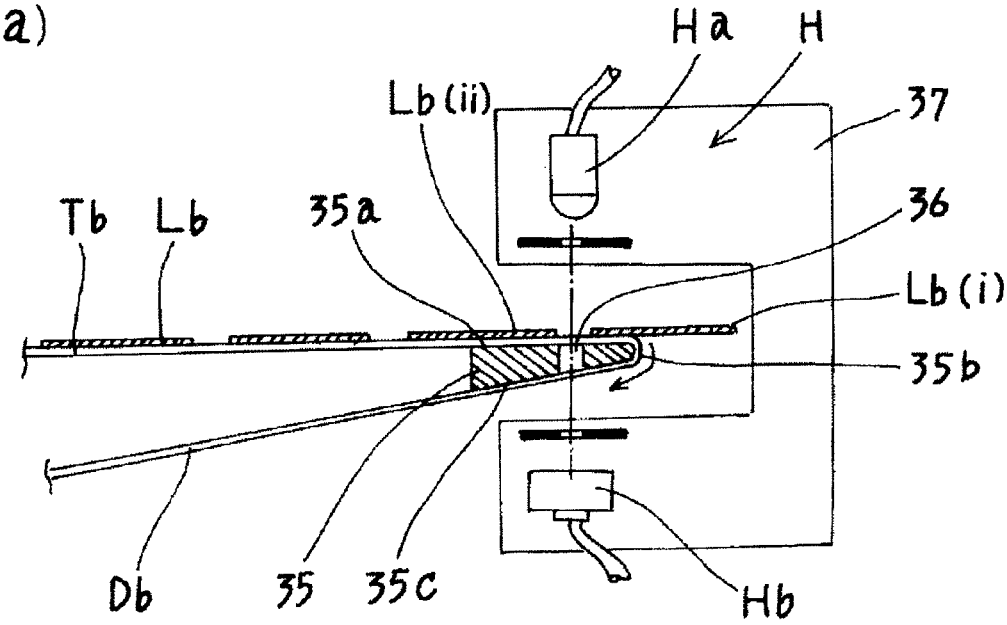
Figure 4:
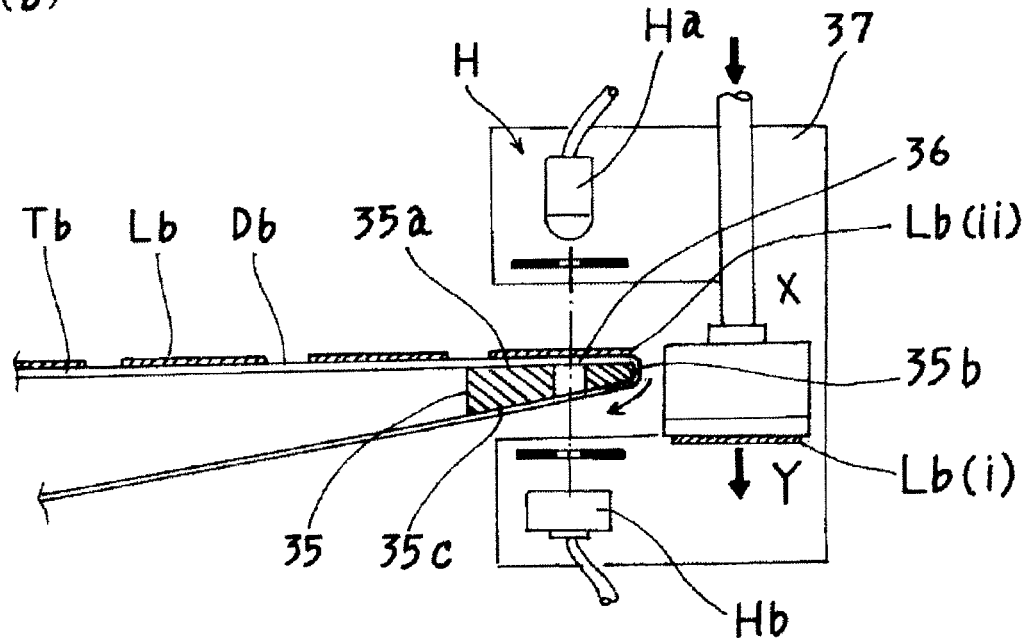

Furthermore, as shown in FIG. 4, the separating unit 30 includes a separating plate 35 configured to fold back the backing strip Db of the sub-continuous label strip Tb supplied from the supply reel 31, so as to separate each sub-label Lb from the backing strip Db to which the sub-label Lb has been temporarily bonded. The separating plate 35 is configured including an upper face 35*a* configured to support the backing strip Db on which the sub-labels Lb have been temporarily bonded; an edge portion 35*b* at which the backing strip Db is to be folded back; and a lower face 35*c* configured such that it faces the backing strip Db which has been folded back at the edge portion 35*b* where each sub-label Lb has been separated. Furthermore, a through hole 36 is formed in the separating plate 35 on the edge portion 35*b* side, such that it passes through the separating plate 35 from the upper face 35*a* to the lower face 35*c*.

As shown in FIG. 4, the separating unit 30 includes an optical sensor H arranged on the upstream side of the edge portion 35*b* of the separating plate 35, and configured to detect the position of a sub-label Lb(ii) which is positioned downstream of a sub-label Lb(i) which is being separated. The optical sensor H is provided to the second base 21 via a support member 37. The optical sensor H is configured including a light-emitting unit Ha and a light receiving unit Hb. The light-emitting unit Ha is configured as a red LED, for example. The optical sensor H is configured such that the light emitted from the light-emitting unit Ha passes through the backing strip Db positioned on the upper face 35*a* side of the separating plate 35, and further passes through the backing strip Db positioned on the lower face 35*c* side of the separating plate 35 via the through hole 36 formed in the separating plate 35. With such an arrangement, the light-receiving unit Hb is configured as a photo IC diode, for example. The light receiving unit Hb is arranged so as to receive the light that has passed through the backing strip Db positioned on the lower face 35*c* side of the separating plate 35.

With the embodiment, the optical sensor H is configured to detect the leading edge of the sub-label Lb(ii) positioned immediately after the sub-label Lb(i) which is being separated. A control unit (not shown) is configured to suspend a conveyance operation for conveying the sub-continuous label strip Tb based on the detection result obtained by the optical sensor H. Specifically, the unshown control unit is configured to suspend the driving operation of the electric motor configured to drive the conveyance roller 32 based on the detection result obtained by the optical sensor H. As shown in FIG. 4B, after the leading edge of the sub-label Lb(ii), which is positioned immediately after the sub-label Lb(i) which is being separated, is detected, the driving operation of the electric motor is suspended at a timing at which the leading edge of the sub-label Lb(ii) thus detected reaches the position of the edge portion 35*b* of the separating plate 35. Subsequently, the control unit is configured to restore the driving operation of the electric motor configured to drive the conveyance roller 32 according to a start-up command at a predetermined time point after the bonding of the sub-label Lb is performed by means of the attracting and holding plate 41 described later.

Furthermore, the bonding unit 40 of the sub-label bonding mechanism 20 is configured to move the position of the attracting and holding plate 41 between the attracting and holding position X, where the sub-label Lb separated by the separating unit 30 is held by attracting and holding such that its attracting and holding face is in contact with the front face side of the sub-label Lb, and the bonding position Y, where the sub-label Lb thus held by attracting and holding is bonded to the main label La temporarily bonded to the backing strip Da mounted on the aforementioned bonding table 5. The attracting and holding plate 41 is configured to be moved between the attracting and holding position X and the bonding position Y by means of an air cylinder apparatus 44 that comprises a cylinder 42 and a piston 43. The cylinder 42 of the air cylinder apparatus 44 is supported on the second base 21.

Figure 6:
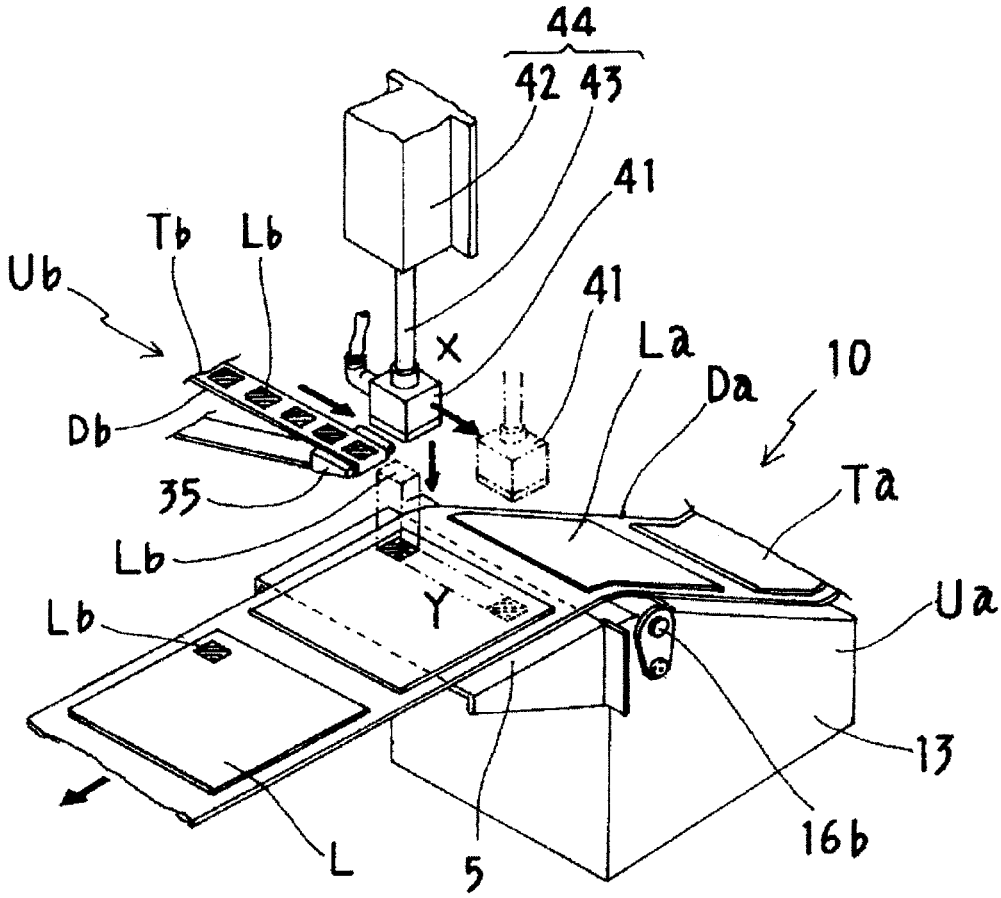
FIG. 6 is a perspective view of principal components showing the operation of the display label manufacturing apparatus according to the embodiment of the present invention for adjusting the position relation between the main label and the attracting and holding plate of the sub-label bonding mechanism.

Furthermore, as shown in FIGS. 3 and 6, the sub-label bonding mechanism 20 is configured to allow the attracting and holding position set for the attracting and holding plate 41 to be changed along a direction that crosses the conveyance direction in which the main label La is conveyed on the bonding table 5. Specifically, as shown in FIG. 3, in the sub-label bonding mechanism 20, a sub-label mounting unit Ub is configured such that the separating unit 30 and the bonding unit 40 are mounted on the second base 21. Furthermore, the sub-label mounting unit Ub is supported on the apparatus base 1 such that it can be moved along a direction that is orthogonal to the conveyance direction in which the main labels La are conveyed, and such that it can be positioned at a desired position. Specifically, a pair of rails 22 is arranged on the second standing plate 4 on its upper side and lower side such that they extend along a direction that is orthogonal to the conveyance direction in which the main label La mounted on the bonding table 5 is conveyed. Furthermore, sliders (not shown) are supported such that they can be slid along the rails 22. Moreover, the second base 21 is supported by the sliders via screws 23. By tightening the screws 23, such an arrangement allows the user to fix the slider on the rails 22, thereby enabling positioning of the attracting and holding position set for the attracting and holding plate 41 mounted on the second base 21. Furthermore, by loosening the screws 23, such an arrangement allows the user to move the sliders, thereby allowing the attracting and holding position set for the attracting and holding plate 41 mounted on the second base 21 to be changed. A slot 24 is formed in each rail 22, which determines the range of movement of the screws 23, i.e., the range of movement of the second base plate 21 (the range of movement of the attracting and holding plate 41). Thus, such an arrangement allows the second base 21 to be moved in this range.

As described above, the main label mounting unit Ua is supported on the apparatus base 1 so as to allow the user to move the main label mounting unit Ua along the conveyance direction in which the main label La is conveyed on the bonding table 5, and to position the main label mounting unit Ua at a desired position. Furthermore, the sub-label mounting unit Ub is supported on the apparatus base 1 so as to allow the user to move the sub-label mounting unit Ub along a direction that is orthogonal to the conveyance direction in which the main label La is conveyed, and to position the sub-label mounting unit Ub at a desired position. Thus, such an arrangement allows the user to adjust the relative bonding position relation between the sub-label bonding mechanism 20 and the main label La.

Thus, with the display label manufacturing apparatus S according to the embodiment of the present invention, the display label L is manufactured as follows. First, the relative bonding position relation between the sub-label bonding mechanism 20 and the main label La is adjusted so as to allow the attracting and holding plate 41 of the sub-label bonding mechanism 20 to bond the sub-label Lb to the main label La at a predetermined position, e.g., at the position at which a barcode has been printed. In this case, as shown in FIGS. 2 and 5, the main label mounting unit Ua is moved along the conveyance direction in which the main label La is conveyed on the bonding table 5, such that it is positioned at a desired position. With the main label conveyance mechanism 10, the conveyance length, which is the length of the main continuous label strip Ta conveyed from the printing unit 16, is set to a predetermined length. Thus, by moving the position of the printing unit 16 such that it is positioned at a required position, such an arrangement allows the user to change the stop position set for the main label La with respect to the bonding table 5, thereby adjusting and determining the relative bonding position relation between the main label La and the attracting and holding plate 41 along the direction in which the main label La is conveyed on the bonding table 5.

Furthermore, as shown in FIGS. 3 and 6, the sub-label mounting unit Ub is moved along a direction that is orthogonal to the conveyance direction in which the main label La is conveyed, and is positioned at a desired position. Thus, such an arrangement allows the user to change the attracting and holding position set for the attracting and holding plate 41 of the sub-label bonding mechanism 20, thereby adjusting and determining the relative bonding position relation between the main label La and the attracting and holding plate 41 along a direction that is orthogonal to the direction in which the main label La is conveyed on the bonding table 5. As described above, such an arrangement allows the user to adjust the position of the printing unit 16 along a single direction, and to adjust the position of the attracting and holding plate 41 along another single direction that is orthogonal to that set for the printing unit 16. Thus, such an arrangement provides a simple configuration, thereby providing highly improved operability. Such an arrangement allows the user to adjust the bonding position in a simple manner in a case in which the bonding position set for the sub-label Lb is to be changed according to a change in the display content to be printed on the main label La, a change in the size of the main label La, and the like.

In this state, the display label manufacturing apparatus S is driven. As shown in FIG. 2, with the main label conveyance mechanism 10, the electric motor 14*a* is started up, which drives the conveyance rollers 14, thereby conveying the main continuous label strip Ta. In the conveyance step, the printing unit 16 prints predetermined information on the main label La temporarily bonded to the backing strip Da. After the printing, the driving operation of the electric motor 14*a* is suspended, which suspends the driving operation of the conveyance rollers 14, thereby positioning the main label La, which is to be subjected to sub-label bonding, at a predetermined position on the bonding table 5 configured to receive the main label La.

On the other hand, as shown in FIG. 3, with the sub-label bonding mechanism 20, an unshown electric motor is started up, which drives the conveyance rollers 32, thereby conveying the sub-continuous label strip Tb. In the conveyance step for conveying the sub-continuous label strip Tb, as shown in FIG. 4A, the backing strip Db of the sub-continuous label strip Tb is folded back by means of the separating plate 35 of the separating unit 30. This separates the sub-label Lb temporarily bonded to the backing strip Db, thereby supplying the sub-label thus separated to the attracting and holding plate 41. The sub-label Lb thus separated is held by attracting and holding by the attracting and holding plate 41 positioned at the attracting and holding position X. With such an arrangement, when the optical sensor H detects the leading edge of the sub-label Lb(ii) immediately after the sub-label Lb(i) which is being separated and which is to be held by attracting and holding, the driving operation of the electric motor is suspended based on the detection result. This suspends the driving operation of the conveyance rollers 32, thereby positioning the sub-label Lb(ii) thus detected at a position at which the leading edge of the sub-label Lb(ii) reaches the edge portion 35*b* of the separating plate 35, as shown in FIG. 4B.

In this case, the light-emitting unit Ha and the light receiving unit Hb are positioned at a position at which the backing strip Db on which the sub-labels Lb are temporarily bonded and the folded-back backing strip Db after the sub-label Lb separation are interposed between them. Thus, such an arrangement allows the angle at which the backing strip Db is folded back to be set to as small an angle as possible, thereby separating the sub-label Lb in a sure manner. Moreover, with such an arrangement in which the light-emitting unit Ha and the light receiving unit Hb are positioned at a position at which the backing strip Db on which the sub-labels Lb are temporarily bonded and the folded-back backing strip Db after the sub-label Lb separation are interposed between them, that is, with this position relation, the through hole 36 is formed in the separating plate 35 on the side of the edge portion 35*b*, which allows the light emitted from the light-emitting unit Ha to reach the light receiving unit Hb via the through hole 36. Thus, such an arrangement is configured to detect the sub-label Lb positioned immediately after the sub-label Lb which is being separated. Thus, there is almost no negative influence of a margin of error, which occurs due to flexure, elongation, or the like of the backing strip Db, on the conveyance of the sub-label Lb to be separated next, after the conveyance of the backing strip Db is suspended and the sub-label Lb to be separated next is positioned at a predetermined position (at a position at which the leading edge of the sub-label Lb reaches the edge portion 35*b* of the separating plate 35) based on the detection of the sub-label Lb obtained by the optical sensor H after the separation of the sub-label Lb to be separated. Thus, such an arrangement provides high-precision positioning of the sub-label Lb to be separated next. As a result, such an arrangement allows the sub-label Lb to be separated in a sure manner, thereby providing improved sub-label separation precision. In particular, such an arrangement has a great advantage in handling a sub-label L having a small size.

In the next step, the air cylinder apparatus 44 is driven, which moves the attracting and holding plate 41 from the attracting and holding position X to the bonding position Y. In this state, the sub-label Lb is bonded to the main label La, thereby forming the display label L on the backing strip Da of the main continuous label strip Ta. Subsequently, the air cylinder apparatus 44 is driven again, which moves the attracting and holding plate 41 from the bonding position Y to the attracting and holding position X.

With such an arrangement, the sub-label Lb is held by attracting and holding by the attracting and holding plate 41, and the sub-label Lb thus held is bonded to the main label La. Thus, such an arrangement allows the sub-label Lb to be bonded to the main label La in a sure manner. That is to say, in the main continuous label strip Ta conveyance step, the sub-label bonding mechanism 20 is configured to separate the sub-label Lb of the sub-continuous label strip Tb thus conveyed from the backing strip Db, and to bond the sub-label Lb thus separated to the surface of the main label La of the main continuous label strip Ta. Thus, such an arrangement allows the display label L to be formed by automation on the backing strip Da of the main continuous label strip Ta. For example, in a case of manufacturing the display label L having a structure in which the sub-label Lb configured as a hologram sheet having a smaller size than that of the main label La and having an adhesive layer on its back face is bonded to the main label La, such an arrangement allows the sub-label Lb to be bonded to the main label La having the information displayed on its surface at a predetermined position specified beforehand, e.g., at a position where a barcode has been printed. As described above, each sub-label is sequentially bonded to the surface of the corresponding main label La, thereby providing automated manufacturing of the display labels L on the backing strip Da of the main continuous label strip Ta.

In a case in which a different kind of display label L is to be manufactured, as described above with reference to FIGS. 2 and 5, and 3 and 6, the main label mounting unit Ua is moved along the conveyance direction in which the main label La is conveyed on the bonding table 5, and is positioned at a desired position. Furthermore, the sub-label mounting unit Ub is moved in a direction that is orthogonal to the conveyance direction in which the main label La is conveyed, and is positioned at a desired position. This allows the relative bonding position relation between the sub-label bonding mechanism 20 and the main label La to be adjusted so as to allow the sub-label bonding mechanism 20 to bond the sub-label Lb to the main label La at a predetermined position. In a case in which the content to be displayed on the main label La is changed, or the size of the main label La is changed, or the like, there is a need to change the bonding position at which the sub-label Lb is to be bonded. With the apparatus according to the present invention, by adjusting the bonding position beforehand, such an arrangement allows the sub-label conveyance mechanism 20 to bond the sub-label Lb to the main label La at a predetermined position. Thus, such an arrangement is capable of supporting the manufacture of various kinds of display labels L.

It should be noted that, with the aforementioned embodiment, the configurations of the main label conveyance mechanism 10, the sub-label bonding mechanism 20, and so forth, are not restricted to the aforementioned configurations. Rather, various modifications may be made.

REFERENCE SIGNS LIST

S display label manufacturing apparatus
L display label
La main label
Da backing strip
Ta main continuous label strip
Lb sub-label
Db backing strip
Tb sub-continuous label strip
1 apparatus base
3 first standing plate
4 second standing plate
5 bonding table
10 main label conveyance mechanism
11 first base
14 conveyance roller
14*a* electronic motor
16 printing unit
Ua main label mounting unit
17 rail
20 sub-label bonding mechanism
21 second base
22 rail
30 separating unit
32 conveyance roller
35 separating plate
35*a* upper face
35*b* edge portion
35*c* lower face
36 through hole
H optical sensor
Ha light-emitting unit
Hb light receiving unit
40 bonding unit
41 attracting and holding plate
X attracting and holding position
Y bonding position
44 air cylinder apparatus
Ub sub-label mounting unit

The invention claimed is:

1. A display label manufacturing apparatus configured to manufacture a display, label wherein the display label comprises:

a main label having a front face and being configured to have information displayed on the front face;

a sub-label having a back face; an adhesive layer bonded between the front face of the main layer and the back face of the sub-label, and the main and sub-labels and the adhesive layer being configured and located such that the sub-label may be bonded on the main label at a predetermined position on the main label;

the display label manufacturing apparatus uses as a first workpiece a main continuous label strip having a structure in which a plurality of the main labels are arranged in series at predetermined intervals on a first backing strip and the main labels are temporarily bonded to the first backing strip, and uses as a second workpiece a sub-continuous label strip having a structure in which a plurality of the sub-labels are arranged in series at predetermined intervals on a second backing strip and the sub-labels are temporarily bonded to the second backing strip;

wherein the display label manufacturing apparatus comprises:

a main label conveyance mechanism located and configured to convey the main continuous label strip along a first longitudinal direction;

a sub-label conveyance mechanism located and configured to convey the sub-continuous label strip along a second longitudinal direction toward the main continuous label strip;

a sub-label separator located before the sub-continuous label strip moving in the second longitudinal direction would cross over the main continuous label strip, and the sub-label separator being located where the separated sub-label may be applied to a respective main label then on the first backing strip, the sub-label separator being configured to separate the sub-label of the sub-continuous label strip thus conveyed from the second backing strip, and a bonding mechanism to then bond the sub-label thus separated to the front face of the respective main label which is on the main continuous label strip and that is then at the bonding mechanism, thereby manufacturing the display label, which is comprised of the main label that is then at the bonding mechanism and of the sub-label applied on and bonded to that main label, and the manufacturing being performed while that main label is on the first backing strip of the main continuous label strip, wherein the display label manufacturing apparatus is configured to allow a bonding position of the sub-label relative to a portion of the main label to be adjusted so as to allow the bonding mechanism to bond the sub-label to the respective main label at a predetermined position of the main label that is then at the bonding mechanism and the sub-label being bonded to that main label;

a bonding table configured to receive the main continuous label strip as the main continuous label strip is conveyed by the main label conveyance mechanism so as to allow bonding of the sub-label to a respective main label;

the sub-label conveyance mechanism conveys the sub-continuous label strip along the second longitudinal direction to the bonding mechanism:

the sub-label separator is configured to fold back the second backing strip of the sub-continuous label strip at the sub-label that is then approaching the bonding mechanism, to thereby separate the sub-label that is then temporarily bonded to the second backing strip as that sub-label is then approaching the bonding mechanism; and the bonding mechanism comprising an attracting and holding plate having an attracting and holding face, the plate is configured and operable to move between an attracting and holding position, at which the sub-label separated by the sub-label separator is located to be held by the attracting and holding face, and a bonding position at which the sub-label that is being held by the attracting and holding face is bonded to the front face of the main label then at the bonding position, while the main label remains temporarily bonded to the first backing strip;

a printing unit arranged on an upstream side of the bonding table with respect to the first longitudinal direction of the main continuous label strip, the printing unit is configured to print and display information on the front face of the main label of the main continuous label strip;

the main label conveyance mechanism is configured to convey the main continuous label strip by a predetermined length from the printing unit, and to hold the respective main label to which the respective sub-label is to be bonded on the bonding table during a bonding period in which the bonding mechanism performs bonding of the sub-label on the respective main label;

the printing unit is configured to be moved with respect to the bonding table, thereby allowing a stop position set for the main label to be changed with respect to the bonding table; and the sub-label bonding mechanism is configured to allow the position of the attracting and holding plate of the bonding mechanism to be changed along a path of the second longitudinal direction that crosses the first longitudinal direction in which the main label is conveyed on the bonding table.

2. The display label manufacturing apparatus according to claim 1, further comprising:

an apparatus base comprising the bonding table;

a main label mounting unit comprising the printing unit;

a sub-label mounting unit comprising the bonding mechanism;

the main label mounting unit is supported on the apparatus base so as to allow the main label mounting unit to be moved along the first longitudinal direction in which the main label is conveyed on the bonding table, and to allow the main label to be positioned at a desired position; and the sub-label mounting unit is supported on the apparatus base so as to allow the sub-label mounting unit to be moved in the second longitudinal direction which is orthogonal to the first longitudinal direction in which the main label is conveyed, so each main label is positioned at a desired position for applying the respective sub-label that is then at the attracting and holding plate to a desired location on the main label that is then at the desired position.

3. The display label manufacturing apparatus according to claim 1, further comprising:

an apparatus base comprising the bonding table;

a main label mounting unit comprising the printing unit;

a sub-label mounting unit comprising the bonding mechanism;

the main label mounting unit is supported on the apparatus base so as to allow the main label mounting unit to be moved along the first longitudinal direction in which the main label is conveyed on the bonding table, and to allow the main label to be positioned at a desired position; and the sub-label mounting unit is supported on the apparatus base so as to allow the sub-label mounting unit to be moved in the second longitudinal direction which is across the first longitudinal direction in which the main label is conveyed, for positioning each sub-label at a position for applying the sub-label then at the attracting and holding plate to a desired position on the respective main label.

4. The display label manufacturing apparatus according to claim 1, further comprising a first sub-label separator configured for separating each sub-label on the second sub-label backing strip from the sub-label backing strip, and the sub-label separator is located where each sub-label arrives at the attracting and holding plate.

5. The display label manufacturing apparatus according to claim 4, wherein the sub-label separator is configured to fold back the second backing strip of the sub-continuous label strip that is moving toward the bonding mechanism to separate the sub-label that is approaching the bonding mechanism from being temporarily bonded to the second backing strip.

6. The display label manufacturing apparatus according to claim 5, further comprising a main label separator configured for separating each main label in turn from the first main label backing strip, the main label separator is located in the first longitudinal direction after the attracting and holding plate applies and bonds a respective one of the sub-labels to a respective main label.

7. The display label manufacturing apparatus according to claim 1, wherein the adhesive layer for bonding is on the back face of the sub-label.

* * * * *